United States Patent [19]

Nichols

[11] Patent Number: 5,071,313

[45] Date of Patent: Dec. 10, 1991

[54] ROTOR BLADE SHROUD SEGMENT

[75] Inventor: Herbert E. Nichols, Cincinnati, Ohio

[73] Assignee: General Electric Company, Cincinnati, Ohio

[21] Appl. No.: 465,844

[22] Filed: Jan. 16, 1990

[51] Int. Cl.[5] ..... F01D 25/26

[52] U.S. Cl. ..... 415/134.000; 415/173.3

[58] Field of Search ..... 415/12, 114, 115, 116, 415/117, 134, 135, 136, 137, 138, 139, 173.1, 173.2, 173.3

[56] References Cited

U.S. PATENT DOCUMENTS

| | | | |
|---|---|---|---|
| 2,823,890 | 2/1958 | Oechslin | 415/136 |
| 3,365,173 | 1/1968 | Lynch et al. | 253/78 |
| 3,412,977 | 11/1968 | Moyer et al. | 253/39 |
| 3,730,640 | 5/1973 | Rice et al. | 415/117 |
| 3,781,125 | 12/1973 | Rahaim et al. | 415/115 |
| 3,860,358 | 1/1975 | Cavicchi et al. | 415/174 |
| 4,177,004 | 12/1979 | Riedmiller et al. | 415/116 |
| 4,251,185 | 2/1981 | Karstensen | 415/136 |
| 4,511,306 | 4/1985 | Hultgren | 415/136 |
| 4,650,395 | 3/1987 | Weidner | 415/115 |

FOREIGN PATENT DOCUMENTS

| | | | |
|---|---|---|---|
| 482528 | 4/1952 | Canada | 415/135 |

*Primary Examiner*—Edward K. Look
*Assistant Examiner*—James A. Larson
*Attorney, Agent, or Firm*—Jerome C. Squillaro

[57] ABSTRACT

A shroud segment adapted to mount to the casing of the turbine or compressor of a gas turbine engine includes opposed ends, an inner face, an outer face and forward and aft side mounting rails. The forward and aft side mounting rails are each formed with a pair of substantially T-shaped relief slots having a straight stem section extending inwardly from the outer face of the shroud body toward the inner face, and an arcuate-shaped head section connected to the stem section which reduces stress concentrations at the base of the stem section of the relief slot.

9 Claims, 2 Drawing Sheets

ROTOR BLADE SHROUD SEGMENT

FIELD OF THE INVENTION

This invention relates to gas turbine engines, and, more particularly, to improved shroud segments mounted to the casing of the high pressure turbine or compressor of a gas turbine engine such as a jet engine.

BACKGROUND OF THE INVENTION

The turbines and compressors of gas turbine engines such as jet engines each include one or more circumferentially extending rows or stages of rotating rotor blades which are axially spaced between rows or stages of fixed stator vanes. Each rotor blade has a blade root mounted to the rotor disk, and an air foil extending radially outwardly from the root which terminates at a blade tip. In many gas turbine engine designs, a number of abutting, circumferentially extending shroud segments are carried by the turbine or compressor case to form an essentially continuous cylindrical-shaped surface along which the tips of the rotor blades tangentially pass. Each of these shroud segments includes an outer face, and an inner, arcuate-shaped face along which the blade tips pass, opposite end portions which abut with adjacent shrouds and opposed side mounting rails which mount to stationary hangers on the casing of the turbine and/or compressors.

The shroud segments, particularly those located in the turbine of a jet engine, are subjected to high temperatures at their inner face along which the rotor blades pass. In an effort to lower the temperature of the shroud segments and increase their durability, cooling air from an intermediate stage of the compressor is often directed onto the outer face of the shrouds. This cooling air is intended to reduce the overall temperature of the entire shroud without directly contacting the inner face and disrupting the air flow through the turbine or compressor.

A major design consideration in any jet engine is the reduction of specific fuel consumption. One source of decreased specific fuel consumption in many jet engine designs is pressure losses resulting from the creation of a relatively large radial tip clearance between the tip of the rotor blades and the inner face of the shroud segments. It is believed that one source of increased radial tip clearances is a problem known as "chording". Chording results from the temperature differential between the high temperature inner face and the cooler outer face of the shroud segments. Impingement of cooling air on the outer face of the shroud segments while the inner face is subjected to high temperatures causes the shrouds to chord or "straighten out" circumferentially, i.e., the end portions of the inner face of the shroud tend to move radially outwardly relative to the center portion of the inner face of the shroud. While the interconnection of the side mounting rails of the shroud segments with the stationary hooks on the case of the compressor or turbine is intended to resist chording or "straightening-out" of the shroud segments, such resistance is overcome by the temperature gradient between the outer and inner faces thereof.

In effect, each individual shroud segment behaves as a curved beam and tends to straighten-out circumferentially from end-to-end in response to the radial temperature gradient. As a result, a wedge-shaped space or gap is created between the tip of the rotor blades and each end portion of the inner face of the shroud segments as the rotor blades are moved therepast. Such chording can also cause additional blade tip rubs in the central portion of the shroud segment inner surface. These rubs produce friction which further increases the radial temperature gradient, thereby causing even further chording and rubs. This increase in radial tip clearance at the end portions of each shroud segment has been found to be equivalent to a uniform tip clearance increase of about 0.004 inches in some types of jet engines, resulting in the significant reduction of specific fuel consumption, e.g., of about 0.4%.

One attempt to reduce chording, or the straightening out of the shroud segments, has been to form one or more radially extending notches or grooves in each of the side mounting rails of the shroud segments which mount to stationary structure of the turbine or compressor casing. These radial grooves are intended to reduce or eliminate the "beam strength" of the shroud segments by making them discontinuous along the length of their side mounting rails.

It has been found that the presence of radial notches or grooves in the shroud segments creates high stress concentrations at the inner end of such grooves. These stress concentrations can create cracking or fracturing of the shroud segments which can propagate from the groove and result in premature failure of the shroud segment.

SUMMARY OF THE INVENTION

It is therefore among the objectives of this invention to provide shroud segments adapted to mount to the casing of the turbine or compressor of a gas turbine engine, such as a jet engine, which improve specific fuel consumption of the jet engine and which exhibit improved durability.

These objectives are accomplished in a shroud segment having opposed end portions, an outer face, an arcuate-shaped inner face and forward and aft side mounting rails which are adapted to mount to fixed support structure on the casing of a turbine or compressor of a jet engine. Both side mounting rails include relief grooves near the opposed ends of the shroud segment which are formed in an inverted T-shape including a straight stem section extending radially inwardly from the outer face of the shroud segment toward its inner face, and a concavely arcuate or U-shaped head section which is connected to the stem section and extends in a direction toward the opposite end portions of the shroud segment.

The T-shaped relief grooves in the forward and aft side mounting rails are effective to prevent "beam bending" of the shroud segment while avoiding stress concentrations which could lead to cracking and failure of the shroud segment. The straight, stem section of the T-shaped relief groove creates a discontinuity along the length of the forward and aft side mounting rails which substantially prevents beam bending or "chording", i.e., the transmission of bending forces along the length of the shroud segment induced by a radial temperature differential between its inner and outer faces. That is, the opposed end portions of the shroud segment are substantially prevented from bending radially outwardly with respect to the center portion thereof as the outer surface is impinged with cooling air while the inner face is subjected to high temperatures. As a result, the radial tip clearance between the tip of each rotor blade and the arcuate inner surface of the shroud segments is maintained substantially constant, particularly at the end portions of the shroud segment, where a relatively large gap had often been formed in other shroud segment designs.

The inner end of the straight, stem section of each T-shaped relief groove terminates at the concavely arcuate or U-shaped head section. It has been found that this gradually curved or arcuate head section of the T-shaped relief groove substantially prevents the formation of stress concentrations in the forward and aft mounting rails of the shroud segment at the inner end of the straight, stem section, which had been a problem in other shroud segment designs. The elimination of stress concentrations within the mounting rails of the shroud segment prevents premature failure thereof and increases its durability.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
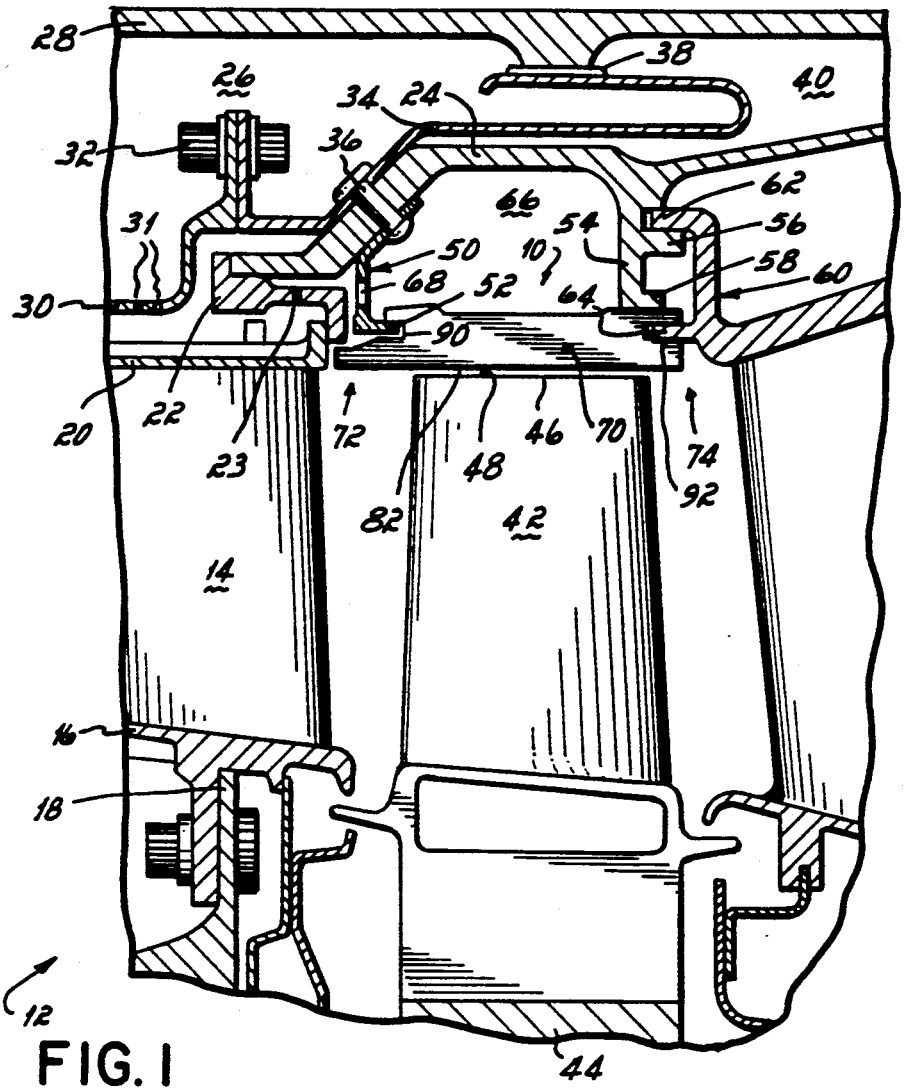
FIG. 1 is a schematic cross sectional view of a portion of the turbine of a jet engine illustrating the mounting of the shroud segment to the turbine case.

Referring now to FIG. 1, a shroud segment 10 in accordance with this invention is shown in position within the turbine 12 of a gas turbine engine such as shown, for example, in U.S. Pat. No. 4,177,004, the disclosure of which is incorporated by reference in its entirety herein. The turbine 12 is shown for purposes of illustrating the positioning of shroud segment 10, and it should be understood that the shroud segment 10 could be utilized in turbines of other designs and/or within the high pressure compressor of a gas turbine engine. The detailed construction of the turbine 12 forms no part of this invention per se and is thus described briefly herein.

A first stage stator vane 14 is bolted at its inner band 16 to a first stage support 18 which provides both radial and axial support for the stator vane 14. An outer band 20 carried by the outside diameter of the stator vane 14 is mounted by a ring 22 to a vane support 24. As used herein, the term "outer" refers to a direction toward the top of FIG. 1, and the term "inner" refers to the opposite direction.

The stator vane 14 is cooled by compressor discharge air which enters a forward plenum 26 defined on its outer side by a compressor rear frame 28 and on its inner side by an impingement plate 30. The term "forward" as used herein refers to the lefthand side of FIG. 1, and "aft" refers to the righthand side of FIG. 1. The impingement plate 30 is secured by a plurality of bolts 32 to a seal 34, and this seal 34 is secured to the vane support 24 by fasteners 36. The seal 34 is annular in shape and extends radially outwardly from the vane support 24 to a pad 38 on the compressor rear frame 28 to isolate the forward plenum 26 from an aft plenum 40 which contains cooling air at a lower pressure and temperature from that of forward plenum 26.

A first stage of rotor blades 42, tangentially rotatable on a rotor disk 44, are located aft of the stator vanes 14 and each have a blade tip 46 immediately adjacent the shroud segments 10. The shroud segments 10 are supported on the stationary structure of the turbine 12, as described below, such that a relatively small radial tip clearance 48 is maintained between the inner face of the shroud segments 10 and the blade tip 46 of the rotor blades 42.

Support for the shroud segments 10 is provided on the forward end by a plurality of shroud support plates 50 which are connected to the vane support 24 by the fasteners 36. Each shroud support plate 50 is formed with an axial flange 52 for mounting the forward side of the shroud segment 10, as described below. Structure for supporting the aft side of shroud segment 10 includes a rim 54 integrally formed with the vane support 24 having an outer flange 56 and an inner flange 58. This rim 54 mounts a C-clamp 60 having an outer flange 62 which engages the outer flange 56 of rim 54, and an inner flange 64 which mounts the shroud segment 10 as described below.

The shroud segment 10 is cooled by cooling air discharged from the compressor (not shown) which enters a cavity 66 formed by the vane support 24, rim 54 and shroud support plates 50. The cooling air enters the cavity 66 through apertures 31 formed in the impingement plate 30, through apertures 23 of ring 22 and an opening 68 in the shroud support plates 50. The cooling air impinges upon the outer surface or face of the shroud segment 10 to reduce the overall temperature of the shroud segment 10.

Figure 3:
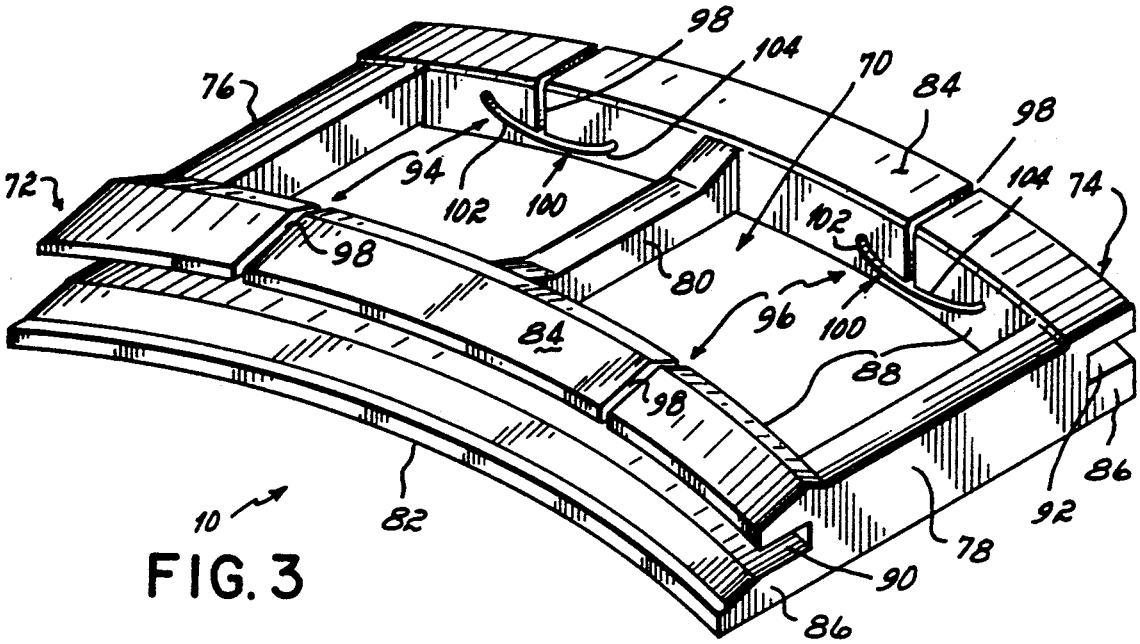
Figure 2:
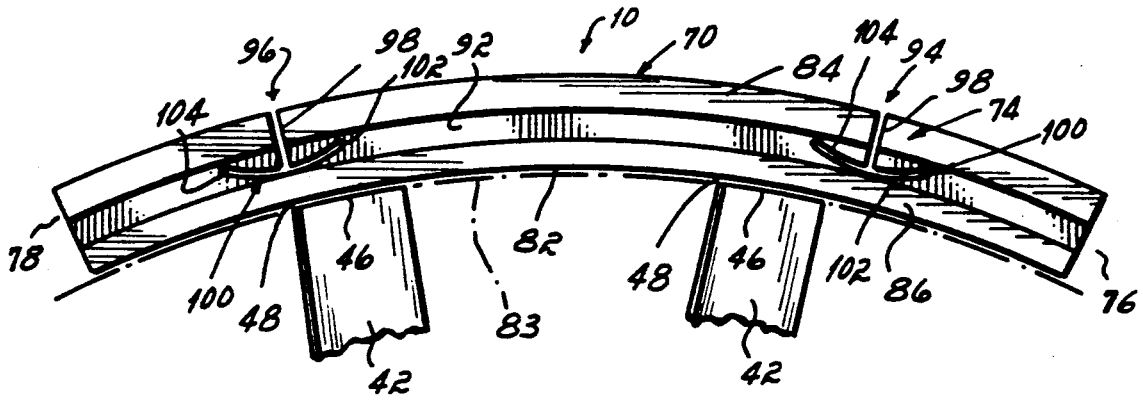
FIG. 2 is an aft elevational view of the shroud segment herein and a pair of turbine blades moving therepast; an FIG. 3 is a perspective view of a single shroud segment of this invention.

Referring now to FIGS. 2 and 3, one of the shroud segments 10 is illustrated in detail. Each shroud segment 10 includes a shroud body 70 formed with a forward side mounting rail 72, an aft side mounting rail 74, opposed end plates 76, 78, a center stiffener 80 extending between the forward and aft side mounting rails 72, 74 and a concavely arcuate inner face 82. As best shown in FIG. 2, the arcuate shape of the inner face 82 of each shroud segment 10 is configured to closely conform to the path 83 of travel of the rotor blade tips 46 as they rotate with the rotor disk 44.

The forward and aft side mounting rails 72, 74 each comprise an outer arm 84 and an inner arm 86 which are both connected at one edge to a side plate 88. The arms 84, 86 of the forward side mounting rail 72 are spaced from one another to form a forward slot 90 which is adapted to receive the axial flange 52 of shroud support segment 50. Similarly, the arms 84, 86 of the aft side mounting rail 74 are formed with an aft slot 92 therebetween which is adapted to receive the inner flange 64 of the C-clamp 60. The shroud segment 10 is thus mounted to the stationary structure of the turbine 12 and a plurality of circumferentially extending shroud segments 10 abut one another at their end plates 76, 78 to form a substantially continuous cylindrical-shaped surface consisting of adjacent inner faces 82 of abutting shroud segments 10.

The forward and aft mounting rails 72, 74 are each formed with first and second relief grooves 94, 96, respectively. The first relief groove 94 in each mounting rail 72, 74 is located between end plate 76 and center stiffener 80, and the second relief groove 96 in each mounting rail 72, 74 is located between the center stiffener 80 and the end plate 78. Both relief grooves 94, 96 are formed in an inverted T-shape including a straight, stem section 98 connected to the center of a concavely arcuate or generally U-shaped head section 100. The stem portion 98 of each relief groove 94, 96 extends radially inwardly from the top of the outer arms 84 toward the inner face 82 of shroud body 70, and terminates at the head section 100. These stem portions 98 pass axially completely through the outer arm 84 of the forward and aft mounting rails 72, 74 and extend partially into the side plates 88. Preferably, the head section 100 of each relief groove 94, 96 is formed in the side plates 88 and extends in a direction between the end plates 76, 78, i.e., one side 102 of the head portion 100 extends from the stem section 98 toward the end plate 76, and the other side 104 of the head section 100 extends in the opposite direction from the stem section 98 toward the end plate 78. Each of the sides 102, 104 of the head section 100 are curved radially outwardly from the stem section 98 of relief grooves 94, 96 toward the top of the outer arm 84 of mounting rails 72, 74 as viewed in FIGS. 2 and 3.

The stem section 98 of relief grooves 94, 96 is effective to create a discontinuity in the forward and aft side mounting rails 72, 74 so that bending forces developed in the shroud body 70 cannot be transmitted along the length thereof. These bending forces result from a temperature differential between the hot inner face 82 of the shroud body 70 and the opposite, outer face which is impinged with cooling air entering the cavity 66, as described above. As a result of the presence of the stem sections 98 of relief grooves 94, 96, the curvature of the inner face 82 of shroud body 70 is maintained substantially constant so that the tip clearance 48 between such inner face 82 and the blade tip 46 of the rotor blades 42 is maintained substantially equidistant along the entire length of the shroud segment 10.

An important aspect of this invention is that the gradually curved or arcuate-shaped head section 100 of each relief groove 94, 96 is effective to substantially eliminate any stress concentrations at the base or inner end of the stem section 98 of such grooves 94, 96 which intersects the head section 100. This protects the forward and aft side mounting rails 72, 74 against cracking or other stress-induced failure throughout operation of the turbine 12.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A shroud segment for a gas turbine engine including rotor blades mounted on a rotor, a stationary casing with a shroud support structure, and a shroud cooling structure, said shroud segment comprising:

an aft side, a forward side, a first end, a second end, an inner face and an outer face, said inner face being formed in a concavely arcuate shape between said first and second ends;

support means formed along each of said forward and aft sides for mounting to the shroud support structure;

each of said support means being formed with at least one relief slot, each of said relief slots being formed with a first portion extending from said outer face toward said inner face, and a second portion connected to said first portion which is substantially arcuate in shape and extends in a direction between said first and second ends.

2. The shroud segment of claim 1 in which said first portion of each of said relief slots forms a gap in said support means on said forward and aft sides intermediate said first and second ends, said gaps being effective to substantially prevent bending of said inner face at said first and second ends upon exposure of said inner and outer faces to a temperature differential so that a substantially constant clearance is maintained between said inner face and the rotor blades.

3. The shroud segment of claim 1 in which each of said support means comprises an inner member, an outer member and a side member connected to said inner and outer members, said inner and outer members having a slot therebetween which receives the shroud support structure, said first portion of each of said relief slots being formed in said outer member and a part of said side member, and said second portion of each of said relief slots being formed in said side member.

4. The shroud segment of claim 3 in which said second portion of each of said relief slots is formed in a concavely arcuate shape including a center section connected to said first portion of said relief slot and opposed end sections, one of said opposed end sections extending in a direction from said center section toward said first end and the other of said opposed end sections extending in a direction from said center section toward said second end.

5. A shroud segment for a gas turbine engine including rotor blades mounted on a rotor, a stationary casing with a shroud support structure, and a shroud cooling structure, said shroud segment comprising:

an aft side, a forward side, a first end, a second end, an inner face and an outer face, said inner face being formed in a concavely arcuate shape between said first and second ends;

a forward mounting rail formed on said forward side and an aft mounting rail formed on said aft side, said forward and aft mounting rails being adapted to mount to the shroud support structure;

said forward and aft mounting rails each being formed with a relief slot proximate said first end and said second end, each of said relief slots being formed in substantially a T-shape including a straight, stem section extending from said outer face toward said inner face, and an arcuate-shaped head section connected to said stem section which extends in a direction between said first and second ends.

6. The shroud segment of claim 5 in which each of said forward and aft mounting rails comprises an inner member, an outer member and a side member connected to said inner and outer members, said inner and outer members having a slot therebetween which receives the shroud support structure, said stem section of each of said relief slots being formed in said outer member and a part of said side member, and said arcuate head section of each of said relief slots being formed in said side member.

7. The shroud segment of claim 5 in which said arcuate-shaped head section of each of said T-shaped relief slots includes a center portion connected to said straight, stem section of said T-shaped relief slot and an end portion on either side of said center portion, one of said end portions extending in a direction from said center portion toward said first end and the other end portion extending in a direction from said center portion toward said second end.

8. A shroud segment for a gas turbine engine including rotor blades mounted on a rotor, a stationary casing with a shroud support structure, and a shroud cooling structure, said shroud segment comprising:

an aft side, a forward side, a first end, a second end, an inner face and an outer face, said inner face being formed in a concavely arcuate shape between said first and second ends;

support means formed along each of said forward and aft sides for mounting to the shroud support structure;

each of said support means including an inner member, and outer member and a side member connected to said inner and outer members, said inner and outer members having a slot therebetween which receives the shroud support structure;

each of said support means being formed with at least one relief slot, each of said relief slots including a first portion being formed in said outer member and a part of said side member, forming a gap in said support means on said forward and aft sides intermediate said first and second ends, extending from said outer face toward said inner face, and a second portion being formed in said member, connected to said first portion, which is substantially arcuate in shape and extends in a direction between said first and second ends;

said gaps being effective to substantially prevent bending of said inner face at said first and second ends upon exposure of said inner and outer faces to a temperature differential so that a substantially constant clearance is maintained between said inner face and the rotor blades.

9. The shroud segment of claim 8 in which said second portion of each of said relief slots is formed in a concavely arcuate shape including a center section connected to said first portion of said relief slot and opposed end sections, one of said opposed end sections extending in a direction from said center section toward said first end and the other of said opposed end sections extending in a direction from said center section toward said second end.

* * * * *